US006183340B1

(12) United States Patent
Wen

(10) Patent No.: US 6,183,340 B1
(45) Date of Patent: Feb. 6, 2001

(54) STRUCTURE OF A BRASSIERE CUP

(76) Inventor: Yang Wen, P.O. Box 82-144, Taipei (TW)

( * ) Notice: Under 35 U.S.C. 154(b), the term of this patent shall be extended for 0 days.

(21) Appl. No.: 09/567,217

(22) Filed: May 9, 2000

(51) Int. Cl.[7] ..... A41C 3/00
(52) U.S. Cl. ..... 450/81; 450/1; 2/267
(58) Field of Search ..... 450/1, 81, 57, 450/37, 54, 39, 51, 56, 40, 82, 30, 32, 55; 2/267

(56) References Cited

U.S. PATENT DOCUMENTS 2,495,307 * 1/1950 Abramson ..... 450/1
5,782,672 * 7/1998 Woodley ..... 450/57
6,036,577 * 3/2000 Coburn ..... 450/57
6,039,629 * 3/2000 Mitchell ..... 450/57

* cited by examiner

*Primary Examiner*—Gloria M. Hale
(74) *Attorney, Agent, or Firm*—A & J

(57) ABSTRACT

A brassiere cup includes a self-adhesive frustum made of self-adhesive neurost imulation, a self-adhesive cone made of self-adhesive neurost imulation and having a center hole, and a conical cup made of silicon rubber and having an inner side formed with a first annular recess around a circumference of the inner side and configured to receive the self-adhesive frumtrum, a second annular recess spaced apart from the first annular recess and configured to receive the self-adhesive cone, and a plurality of protuberances between the first and second annular recesses for massaging breasts, whereby a user can wear strapless dresses or dresses with shoestring straps without worrying about exposure of her nipples.

2 Claims, 3 Drawing Sheets

STRUCTURE OF A BRASSIERE CUP

BACKGROUND OF THE INVENTION

1. Field of the Invention

This invention is related to an improvement in the structure of a brassiere cup and in particular to one which can be worn without straps.

2. Description of the Prior Art

It has been found that conventional brassieres with straps are not suitable for one to wear when one wears camisole dresses without straps or with shoestring straps. Hence, strapless brassieres are generally used together with such dresses, but strapless brassieres tend to slip downwards when the wearer walks so that the wearer must often pull up her brassiere in order to prevent it from slipping downwards. Hence, brassiere wearers have longed for an improvement in the structure of a brassiere cup which can obviate and mitigate the above-mentioned drawbacks.

SUMMARY OF THE INVENTION

This invention is related to an improvement in the structure of a brassiere cup.

It is the primary object of the present invention to provide a brassiere cup which can worn without straps.

It is another object of the present invention to provide a brassiere cup which can be easily attached to or removed from the breast.

It is a further object of the present invention to provide a brassiere cup which can massage the breast of a wearer.

According to a preferred embodiment of the present invention, a brassiere cup includes a self-adhesive frustum made of self-adhesive neurost imulation, a self-adhesive cone made of self-adhesive neurost imulation and having a center hole, and a conical cup made of silicon rubber and having an inner side formed with a first annular recess around a circumference of the inner side and configured to receive the self-adhesive frumtrum, a second annular recess spaced apart from the first annular recess and configured to receive the self-adhesive cone, and a plurality of protuberances between the first and second annular recesses for massaging breasts, whereby a user can wear strapless dresses or dresses with shoestring straps without worrying about exposure of her nipples.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
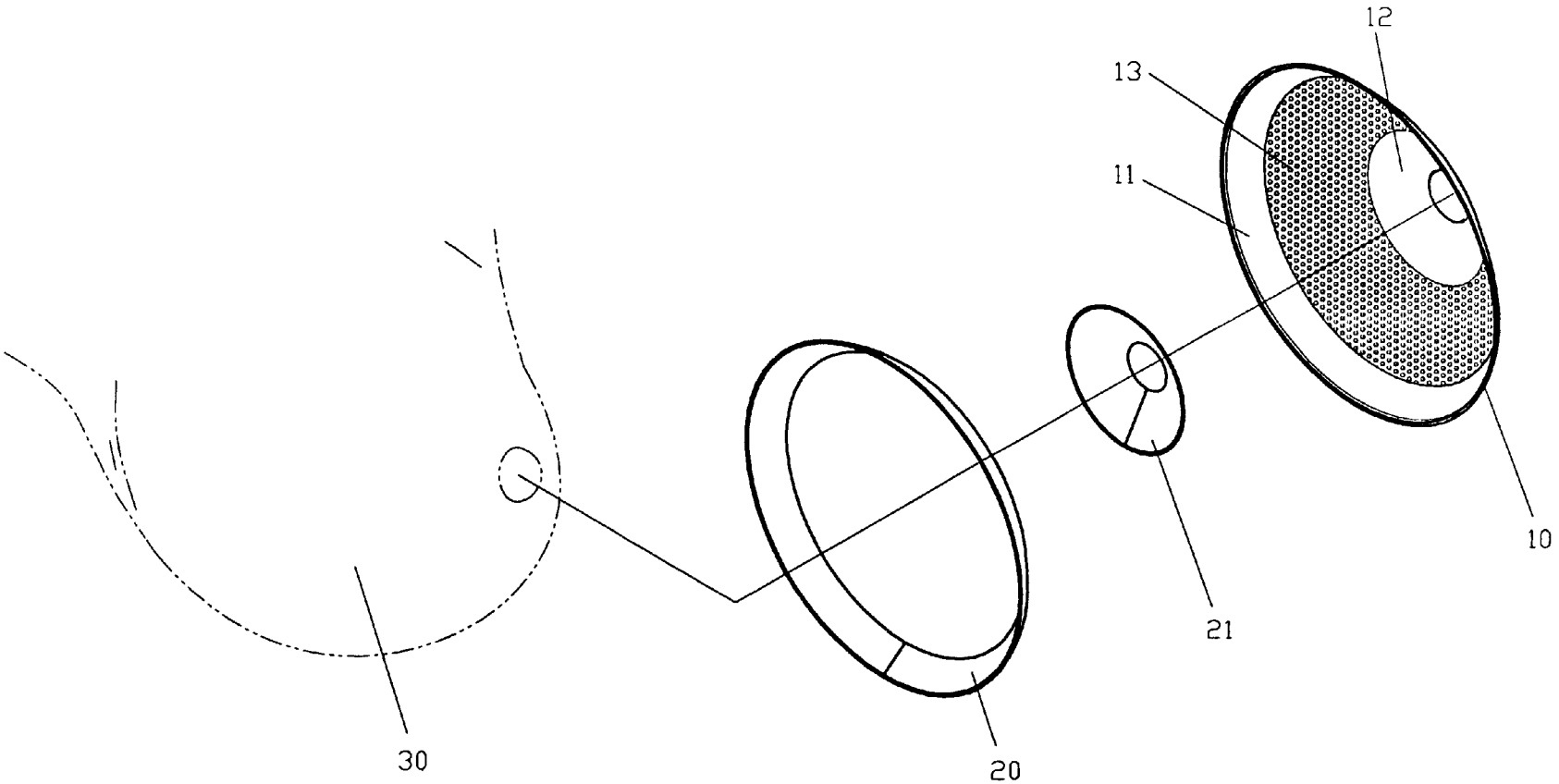
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
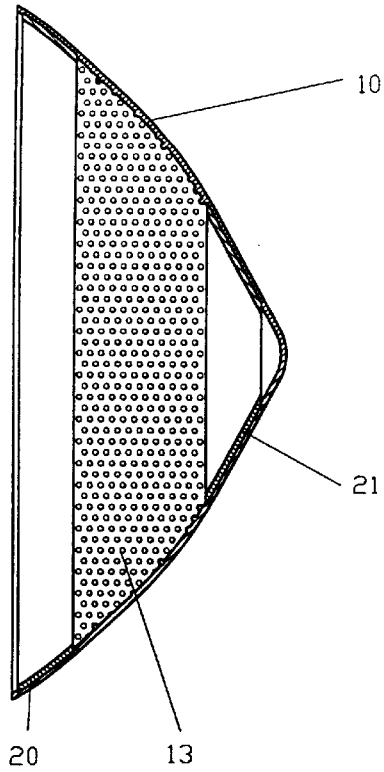
FIG. 2 is a sectional view of the present invention.

With reference to the drawings and in particular to FIGS. 1 and 2 thereof, the brassiere cup according to the present invention generally comprises a conical cup 10, a self-adhesive frustum 20, and a self-adhesive cone 21.

The conical cup 10 has a thickness of 0.5 mm and is preferably made of silicon rubber. The inner side of the conical cup 10 is formed with a first annular recess 11 around the circumference and configured to receive the self-adhesive frustum 20, a second annular recess 12 spaced apart from the first annular recess 11 and configured to receive the self-adhesive cone 21, and a plurality of protuberances 13 between the self-adhesive frustum 20 and the self-adhesive cone 21. The self-adhesive cone 21 has a center hole for the passage of a nipple. The self-adhesive frustum 20 and the self-adhesive cone 21 are made of self-adhesive neurost imulation and have a thickness of 0.5 mm. The self-adhesive neurost imulation is non-toxic and has a pH value of 5.7–6.0, so that it will not make the skin of a user allergic or cause any stimulation to the skin of the user. By means of the self-adhesive frustum 20 and the self-adhesive cone 21, the conical cup can be firmly attached on the breast 30. The self-adhesive frustum 20 and the self-adhesive cone 21 can be replaced as required. The protuberances 13 between the first and second annular recesses 11 and 12 are used for massaging the breast.

Figure 3:
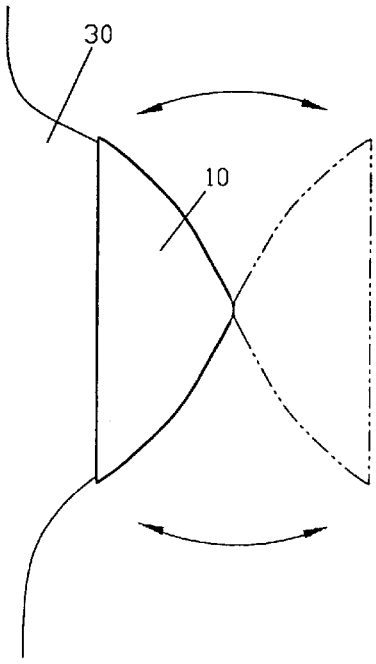
FIG. 3 illustrates how to wear the present invention.

Referring to FIG. 3, when in use, the brassiere cup according to the present invention is first turned over, with the apex of the brassiere cup placed against the nipple and then it is turned back to enclose the breast 30. To take off the brassiere cup, the wearer simply removes it from the breast or turns it over from the breast.

Figure 5:
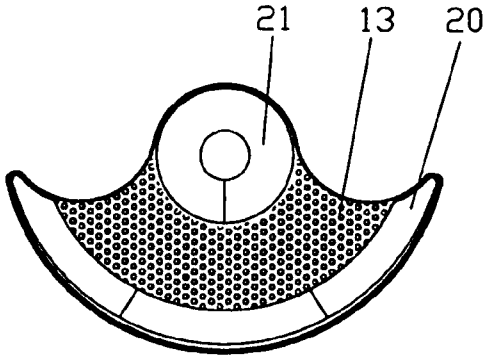
FIG. 5 illustrates another preferred embodiment of the present invention.
Figure 4:
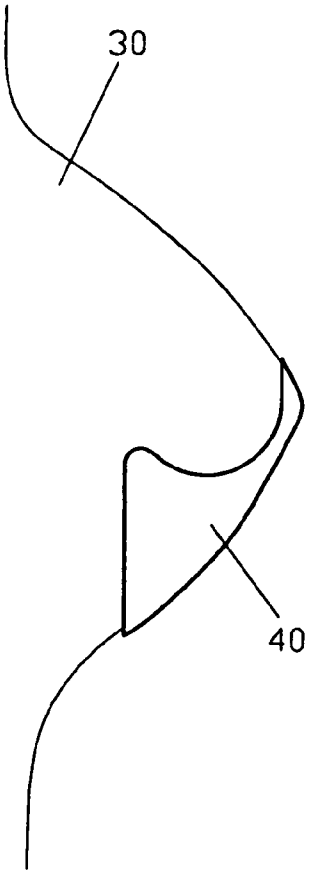
FIG. 4 is a working view of the present invention.

As camisole dresses without straps or with shoestring straps are very popular today, the upper portion of the breast or the breast cleavage is shown so that the conical brassiere cup is not suitable for use in this case. Hence, the brassiere cup according to the present invention may be a one-fourth portion of a cone with two curved recesses at two sides as shown in FIGS. 4 and 5, thereby enabling a user to show the upper portion of her breast and breast cleavage without worrying about the exposure of her nipple. The method of wearing the brassiere cup FIG. 4 is identical to that of FIG. 3, as previously described.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A brassiere cup comprising:

a self-adhesive frustum made of self-adhesive neurost imulation;

a self-adhesive cone made of self-adhesive neurost imulation and having a center hole; and a conical cup made of silicon rubber and having an inner side formed with a first annular recess around a circumference of said inner side and configured to receive said self-adhesive frustum, a second annular recess spaced apart from said first annular recess and configured to receive said self-adhesive cone, and a plurality of protuberances between said first and second annular recesses for massaging breasts.

2. The brassiere cup as claimed in claim 1, wherein said conical cup is of a one-fourth portion of a cone with two curved recesses at two sides thereof.

* * * * *